US005661915A

United States Patent [19]

Smith

[11] Patent Number: 5,661,915

[45] Date of Patent: Sep. 2, 1997

[54] SHOE WITH REMOVABLE SPIKE PLATE

[76] Inventor: Michael R. Smith, P.O. Box 53, Lingle, Wyo. 82223

[21] Appl. No.: 679,843

[22] Filed: Jul. 15, 1996

[51] Int. Cl.[6] ..... A43C 13/00; A43B 3/24; A43B 1/10

[52] U.S. Cl. ..... 36/15; 36/102; 36/101

[58] Field of Search ..... 36/100, 101, 31, 36/132, 136, 15, 7.5, 62, 138, 102, 86

[56] References Cited

U.S. PATENT DOCUMENTS

| | | | |
|---|---|---|---|
| 1,571,498 | 2/1926 | Swanstrom | 36/86 |
| 3,538,628 | 11/1970 | Einstein, Jr. | 36/100 X |
| 4,004,356 | 1/1977 | Green | 36/134 |
| 4,267,650 | 5/1981 | Bauer | 36/101 |
| 4,299,037 | 11/1981 | Carey | 36/62 X |
| 4,317,294 | 3/1982 | Goodyear | 36/100 |
| 4,343,057 | 8/1982 | Bensley | 36/101 X |
| 4,377,042 | 3/1983 | Bauer | 36/101 |
| 4,454,662 | 6/1984 | Stubblefield | 36/102 X |
| 4,523,396 | 6/1985 | Dassler | 36/134 |
| 4,573,457 | 3/1986 | Parks | 36/102 X |
| 4,580,359 | 4/1986 | Kurrash et al. | 36/127 |
| 4,635,383 | 1/1987 | Free | 36/7.6 |
| 4,644,672 | 2/1987 | Dassler et al. | 36/134 |
| 4,676,010 | 6/1987 | Cheskin | 36/32 R |
| 4,742,626 | 5/1988 | Tadiotto | 36/127 |
| 4,807,372 | 2/1989 | McCall | 36/131 X |
| 4,872,273 | 10/1989 | Smeed | 36/7.5 X |
| 4,875,300 | 10/1989 | Kazz | 36/134 |
| 4,910,883 | 3/1990 | Zock, Jr. | 36/7.6 |
| 5,184,410 | 2/1993 | Hamilton | 36/138 X |
| 5,197,210 | 3/1993 | Sink | 36/127 |
| 5,315,768 | 5/1994 | Pacheco | 36/7.1 R |

FOREIGN PATENT DOCUMENTS

| | | | |
|---|---|---|---|
| 341706 | 10/1921 | Germany | 36/15 |

*Primary Examiner*—B. Dayoan

*Attorney, Agent, or Firm*—Zarley, McKee, Thomte Voorhees & Sease; Mark D. Frederiksen

[57] ABSTRACT

A shoe includes a spike plate with spikes thereon, removably attached to a sole portion of the shoe to permit selective removal of the spike plate. The shoe includes a rib extending around the peripheral side wall of the sole, and the spike plate includes an upright wall extending around a peripheral edge of a base plate, the spike plate wall having a groove formed on an interior surface thereof cooperable with the rib to selectively connect the spike plate to the shoe. The spike plate includes a forward section pivotally connected to a rearward section along a transverse axis, to permit the forward section to pivot downwardly generally orthogonal to the rearward section of the spike plate.

9 Claims, 2 Drawing Sheets

SHOE WITH REMOVABLE SPIKE PLATE

TECHNICAL FIELD

The present invention relates generally to golf shoes, and more particularly to improved golf shoes with a removable spike plate to convert the shoes to spikeless street shoes.

BACKGROUND OF THE INVENTION

There are many types of athletic shoes which have spikes or cleats on the sole thereof to give traction to the user of the shoes. One of the most common types of spiked athletic shoe is the golf shoe.

One of the drawbacks to spiked athletic shoes is the amount of time required to remove the shoes and put on conventional street shoes in order to walk through most public places. In addition to the time required to change the shoes, it is necessary to carry a second pair of shoes in some fashion, and then to carry the golf shoes once they have been removed.

SUMMARY OF THE INVENTION

It is therefore a general object of the present invention to provide improved golf shoes with removable spike plates to convert the golf shoes to street shoes.

Another object is to provide convertible golf shoes which permit simple and quick removal of a spike plate from the shoe without requiring tools or the like.

A further object of the present invention is to provide convertible golf shoes which are simple to manufacture, easy to use and economical for the consumer.

These and other objects will be apparent to those skilled in the art.

The shoe of the present invention includes a spike plate with spikes thereon, removably attached to a sole portion of the shoe to permit selective removal of the spike plate. The shoe includes a rib extending around the peripheral side wall of the sole, and the spike plate includes an upright wall extending around a peripheral edge of a base plate, the spike plate wall having a groove formed on an interior surface thereof cooperable with the rib to selectively connect the spike plate to the shoe. The spike plate includes a forward section pivotally connected to a rearward section along a transverse axis, to permit the forward section to pivot downwardly generally orthogonal to the rearward section of the spike plate.

DESCRIPTION OF THE PREFERRED EMBODIMENT

Figure 1:
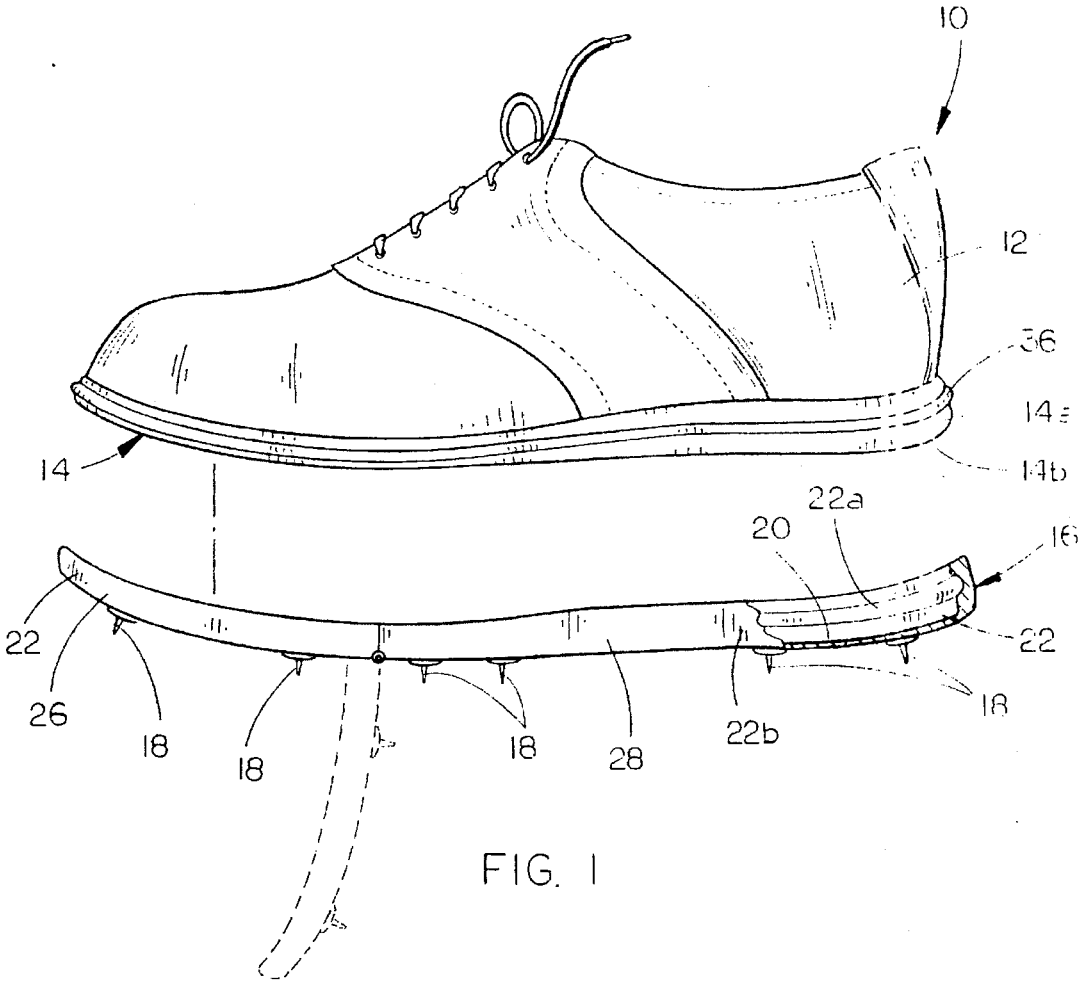
FIG. 1 is an exploded perspective view of the present invention.

Referring now to the drawings, in which similar or corresponding parts are identified with the same reference numeral and more particularly to FIG. 1, the shoe of the present invention is designated generally at 10 and includes an upper portion 12 generally formed of a leather-type material, together with a sole portion 14 typically made of a blown plastic foam such as ethylene vinyl acetate (EVA) or of a rubber material permitting resilient flexibility. Finally, a spike plate 16 is provided for removable attachment to sole portion 14, spike plate 16 having a plurality of spikes 18 depending from the bottom surface thereof.

Spike plate 16 includes a base plate 20 having a shape generally conforming to the shape of the sole portion 14 of shoe 10. A vertical wall 22 projects upwardly continuously along the peripheral edge of base plate 20 and includes an inner face **22*a* and an outer face 22*b***.

Figure 3:
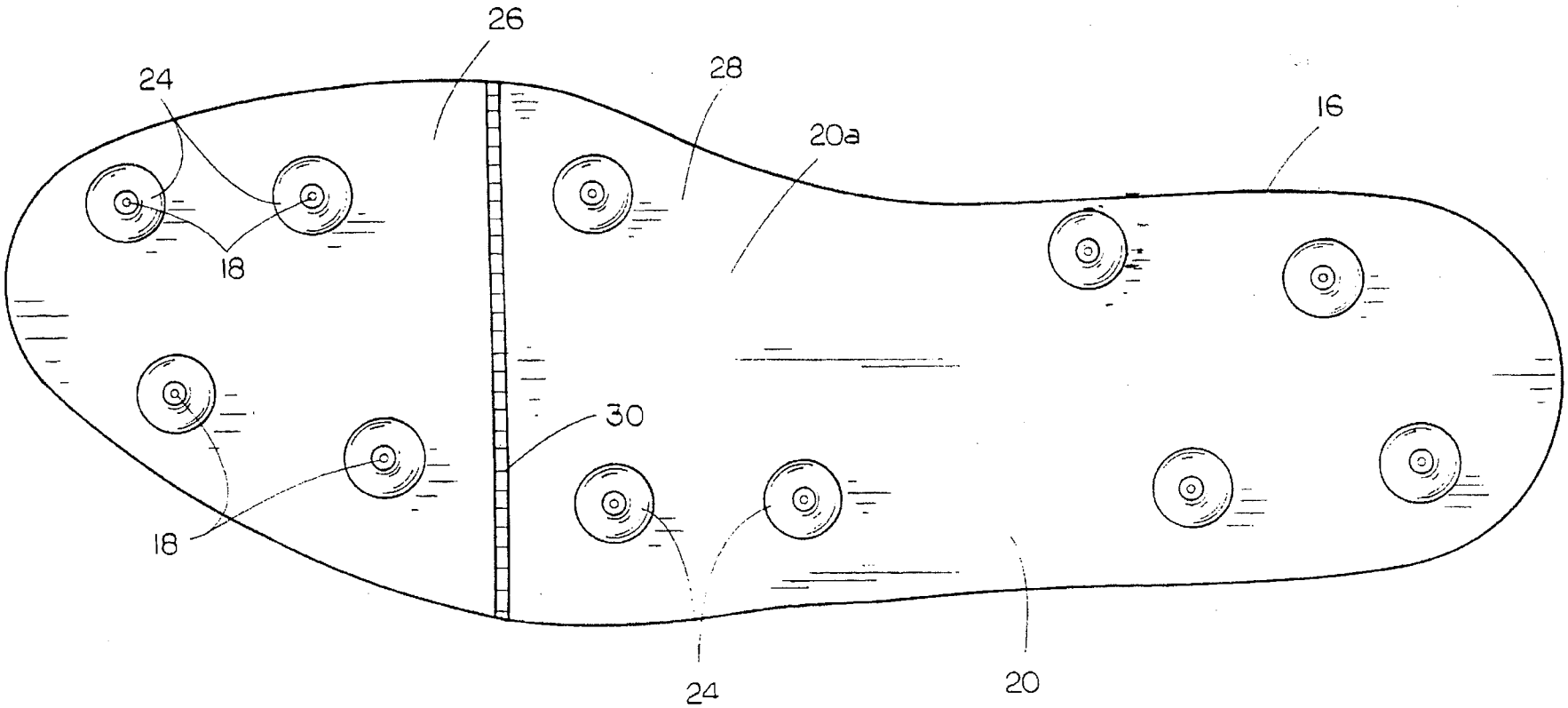
FIG. 3 is a bottom plan view of the spike plate of the invention.

Referring now to FIG. 3, the bottom surface **20*a* of base plate 20 has a plurality of generally circular raised areas 24 formed in spaced apart fashion in predetermined locations across the plate. Each spike 18 is removably mounted in raised areas 24** in a conventional fashion well known in the art.

Spike plate 16 is preferably formed of a plastic material which has resilient flexible characteristics, so as to conform to the sole portion 14 of the shoe. Obviously other materials such as metal or rubber or the like may be utilized as well. Base plate 20 of spike plate 16 includes a forward section 26 which is pivotally connected to a rearward section 28 along a hinge 30. Hinge 30 is preferably oriented transverse to the length of the spike plate 16 at the widest portion of the spike plate generally adjacent the ball of the foot. Hinge 30 permits forward section 26 to pivot downwardly at right angles to rearward section 28 as shown in FIG. 2, for purposes described in more detail hereinbelow.

Figure 2:
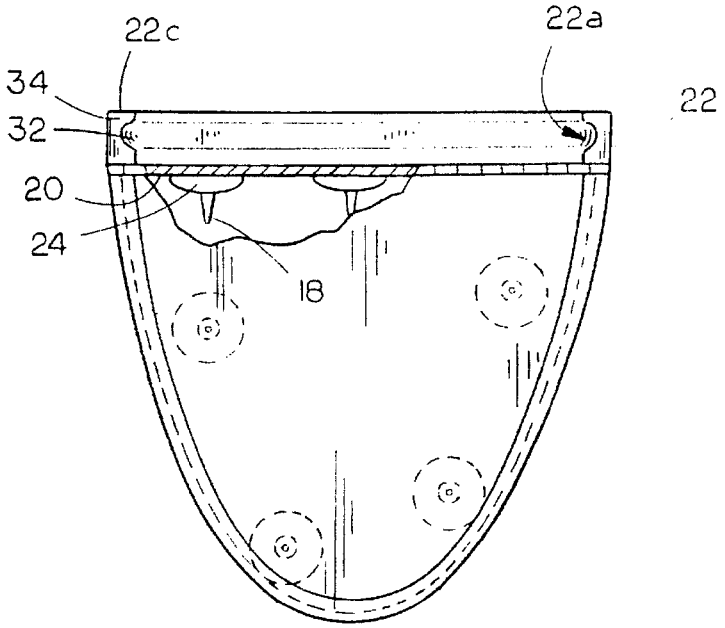
FIG. 2 is an end elevational view of the spike plate portion of the shoe with the forward end pivoted downwardly to an open position.

Referring now to FIG. 2, it can be seen that the interface **22*a* of wall 22 has a generally arcuate groove 32 formed therein which extends around the entire extent of wall 22 generally parallel to base plate 20 and the upper edge 22*c* of wall 22. Groove 32 forms an inwardly projecting lip 34 between groove 32 and upper edge 22*c* of wall 22. Lip 34 has an arcuate inwardly directed face 34**.

Referring once again to FIG. 1, sole portion 14 has a generally vertical exterior face **14*a* extending continuously around the periphery thereof. An outwardly projecting rib 36 is spaced above the bottom surface 14*b* of sole portion 14, a predetermined distance so as to receive groove 32 of spike plate 16** thereon.

In operation, spikes 18 of the preferred length and material are fastened to the bottom of spike plate 16, for the particular sport for which the shoes will be utilized. The forward section 26 of spike plate 16 has been pivoted downwardly to the broken line position shown in FIG. 1. This permits the rearward section 28 to be aligned with rib 36 on sole portion 14 of shoe 10. Spike plate 16 is then moved forwardly until groove 32 on spike plate rearward section 28 engages rib 36 on the rearward portion of sole portion 14. Spike plate forward section 26 is then pivoted upwardly and wall 22 is flexed slightly outwardly such that lip 34 resiliently snaps into position with groove 32 on forward section 26 engaging rib 36 on sole portion 14.

Shoe 10 may then be utilized as a spiked golf shoe or the like, yet permits use as a conventional street shoe, by reversing the process to remove the spike plate from the sole portion 14 of shoe 10.

Whereas the invention has been shown and described in connection with the preferred embodiment thereof, many modifications, substitutions and additions may be made which are within the intended broad scope of the appended claims.

I claim:

1. In combination:

a shoe having a sole portion and an upper portion; and a spike plate having top and bottom surfaces, removably connected to the sole portion of said shoe;

said spike plate including a plurality of spikes depending from the bottom surface thereof;

said spike plate including a generally flat base plate of a resilient flexible material to conform to the sole portion of the shoe when attached to the shoe, and an upright wall extending along a peripheral edge of the spike plate;

said spike plate further including a forward portion and a rearward portion, pivotally connected together by a hinge, the hinge oriented transversely to a longitudinal length of the plate;

said base plate having a width at the hinge greater than a width forwardly and rearwardly of the hinge;

said spike plate peripheral wall having two vertical breaks therein, one located at each end of said hinge, permitting the spike plate forward portion to pivot downwardly at the hinge, separating the wall at the breaks;

a rib projecting outwardly from an outward surface of a vertical peripheral side wall of the sole portion, said rib extending continuously around the entire peripheral side wall of the sole portion;

a groove formed on an inward peripheral vertical surface of the spike plate wall cooperable with said rib to selectively retain the spike plate in position on the shoe, the groove extending continuously around the entire peripheral surface of the wall.

2. The combination of claim 1, wherein the rib is generally parallel to a bottom surface of the sole, and wherein the groove is oriented generally parallel to the base plate.

3. In combination:

a shoe having a sole portion and an upper portion; and a spike plate having top and bottom surfaces removably connected to the sole portion of said shoe;

said spike plate including a plurality of spikes depending from the bottom surface thereof;

said spike plate further including a generally flat base plate and upright wall extending along a peripheral edge of the base plate;

cooperable means on said sole portion and spike plate for selectively removably connecting the spike plate to the shoe; and said base plate having a hinge which pivotally connects a forward portion to a rearward portion, said hinge oriented transverse to a longitudinal axis of the spike plate;

said base plate having a width at the hinge greater than a width forwardly and rearwardly of the hinge;

said spike plate peripheral wall having two vertical breaks therein, one located at each end of said hinge, permitting the spike plate forward portion to pivot downwardly at the hinge, separating the wall at the breaks;.

4. The combination of claim 3, wherein said means for removably connecting the spike plate to the shoe includes: a first half of cooperable means for removably connecting the spike plate to the shoe, mounted on said sole portion of the shoe; and a second half of cooperable means for removably connecting the spike plate to the shoe, mounted on the spike plate.

5. The combination of claim 4, wherein said second half of said connecting means is located on said peripheral wall.

6. The combination of claim 5, wherein said first half of the cooperable connecting means includes a rib projecting outwardly from a vertical peripheral side wall of the sole portion, and wherein said second half of the cooperable connecting means includes a groove formed on an inward peripheral vertical surface of the spike plate wall cooperable with said rib to selectively retain the spike plate in position on the shoe.

7. The combination of claim 6, wherein said rib extends continuously around the entire peripheral side wall of the sole portion.

8. The combination of claim 7, wherein the groove extends continuously around the entire peripheral surface of the wall.

9. The combination of claim 8, wherein the rib is generally parallel to a bottom surface of the sole, and wherein the groove is oriented generally to the base plate.

* * * * *